United States Patent [19]

Hatagishi

[11] Patent Number: 4,869,972

[45] Date of Patent: Sep. 26, 1989

[54] MATERIAL FOR FUSE

[75] Inventor: Yuuji Hatagishi, Shizuoka, Japan

[73] Assignee: Yazaki Corporation, Tokyo, Japan

[21] Appl. No.: 154,021

[22] Filed: Feb. 9, 1988

[30] Foreign Application Priority Data

Apr. 6, 1987 [JP] Japan ..... 62-82873

[51] Int. Cl.[4] ..... H01H 85/06

[52] U.S. Cl. ..... 428/647; 337/295; 337/296; 428/652

[58] Field of Search ..... 428/647, 652; 337/159, 337/160, 295, 296

[56] References Cited

U.S. PATENT DOCUMENTS

| | | | |
|---|---|---|---|
| 2,737,463 | 3/1956 | Lawton et al. | 428/652 |
| 3,042,428 | 7/1962 | Gardiner | 428/652 |
| 3,267,238 | 8/1966 | Arikawa et al. | 337/296 |
| 3,402,255 | 9/1968 | Parker | 428/652 |
| 3,838,376 | 9/1974 | Norholm | 337/295 |
| 3,877,885 | 4/1975 | Sexton | 428/652 |
| 3,939,299 | 2/1976 | Raw et al. | 428/652 |
| 4,303,741 | 12/1981 | Klein | 428/652 |
| 4,323,632 | 4/1982 | Berdan et al. | 428/652 |
| 4,431,710 | 2/1984 | Lifshin et al. | 428/652 |
| 4,672,352 | 6/1987 | Takano | 337/295 |

FOREIGN PATENT DOCUMENTS

| | | | |
|---|---|---|---|
| 28490 | 9/1970 | Japan | 428/652 |
| 103938 | 9/1978 | Japan | 428/652 |
| 53-138918 | 12/1978 | Japan . | |
| 155915 | 12/1979 | Japan | 428/652 |
| 58-163127 | 9/1983 | Japan . | |
| 875502 | 10/1981 | U.S.S.R. | 337/295 |

*Primary Examiner*—Robert McDowell

*Attorney, Agent, or Firm*—Robbins & Laramie

[57] ABSTRACT

Disclosed is a fuse material consisting of aluminum or a rollable aluminum alloy having a copper plating deposited thereon and optionally being provided with a tin plating deposited on the copper plating. A fuse made of the fuse material shows a small temperature rise and has an extended useful service life as compared to conventional fuses.

16 Claims, 3 Drawing Sheets

MATERIAL FOR FUSE

BACKGROUND OF THE INVENTION

1. Field of the Invention

This invention relates to a material for making a fuse which generates a small quantity of heat, which has a long useful service life and which is suitable for use in a circuit where a relatively large current flows.

2. Prior Art

Tubular or planar fuses made of zinc have been widely used hitherto in various circuits in automobiles. A demerit of the fuse made of zinc is its short useful service life although the fuse has such a merit that it generates a small quantity of heat before it breaks the circuit by melt-down and during use under a normal current-conducting condition. With a view to solve the above problem, a fuse made of a zinc-copper alloy containing less than 5% of copper added to zinc has been proposed, as disclosed in JP-A-No. 53-138918. However, it has been pointed out that, when such a fuse is connected in a circuit where a relatively large current of, for example, 20 amperes or more flows, especially when used in a circuit where an inrush current flows due to repeated on-off of a motor, the alloy particles tend to become excessively large due to repeated thermal expansion and contraction, resulting in development of cracks. Thus, the proposed fuse made of such a zinc-copper alloy has a limited useful service life.

Therefore, a fuse made of a copper alloy having a high melting point, as disclosed in JP-A-No. 58-163127, is now commonly used in a circuit where a large current flows. However, the fuse made of such a copper alloy is disadvantageous in that it generates a large quantity of heat although it has a long useful service life.

Generally, the circuit breaking action of a fuse made of a metal takes place when an area of the fuse heated by the joule heat melts down at the melting point of the metal, thereby breaking the circuit. It can be readily understood that a fuse made of a high-melting metal imparts more thermal damage to an adjacent part than a fuse made of a low-melting metal. That is, when a fuse made of a high-melting metal is connected in a circuit using an insulated wire for conducting current, the circuit-breaking melt-down area of the fuse generates more heat than the remaining area even under a normal current-conducting condition, and the portions of the insulation covering (whose typical material is polyvinyl chloride) of the wire adjacent to the fuse are heated by the heat transmitted from the circuit-breaking melt-down area of the fuse, resulting in a promoted degradation of those portions of the insulation covering. Further, it is the recent tendency that automobiles of front-engine front-drive design are gaining popularity, and the output of engine becomes higher and higher. Because of the above tendency, the environment of the engine room becomes increasingly severe, and the environmental temperature is rising more and more. Therefore, it has been demanded to suppress the undesirable temperature rise of heat-generating parts even by an amount of 1° C. at the least.

As means for satisfying the demand for minimizing the quantity of generated heat as well as the demand for ensuring a long useful service life, there is a proposal according to which a metal having a relatively low melting point, for example, silver or aluminum, is used to make a fuse. However, a fuse made of silver has the problem of high cost. Also, when aluminum is used to make a fuse, aluminum forms a tight film of its oxide, and a bridge of alumina may remain in a non-melted state even when the fuse is heated due to flow of an overcurrent until finally its melting point is reached. Further, because aluminum is easily corroded even when its oxide film may not be formed, electrolytic corrosion tends to occur between the fuse and a connection terminal or a wire to which the fuse is connected. Therefore, silver and aluminum are not suitable as the material for making fuses, and those made of silver and aluminum are now scarcely put into practical use.

SUMMARY OF THE INVENTION

It is an object of the present invention to provide a material for making a fuse which generates a small quantity of heat, which has a long useful service life, which can be manufactured at a low cost and which is suitable for use in a circuit where a relatively large current flows.

The inventor conducted research and studies in an effort to solve the prior art problems described above and found out that a fuse made of aluminum plated with copper or a rollable aluminum alloy plated with copper generates a small quantity of heat, has a long useful service life and exhibits a sharp circuit-breaking melt-down characteristic even when it is connected in a circuit conducting a relatively large current.

That is, the present invention is featured by the fact that aluminum or a rollable aluminum alloy having a copper plating is used as a material for making a fuse.

The required thickness of the copper plating is only about 1 to 5 μm. Such a copper plating is easily deposited on one surface or both surfaces of the circuit-breaking melt-down area of the fuse by any one of known means including electroplating, vacuum evaporation and bonding by cold rolling. The temperature rise of the fuse can be further suppressed by depositing a tin plating on the copper plating.

The rollable aluminum alloy preferably used to make the fuse of the present invention is, for example, Al-:A1200 or Al:A2218 specified as a material suitable for making sheets, bars, plates, strips, etc. in JIS (Japanese Industrial Standards).

DETAILED DESCRIPTION OF THE INVENTION

Figure 1:
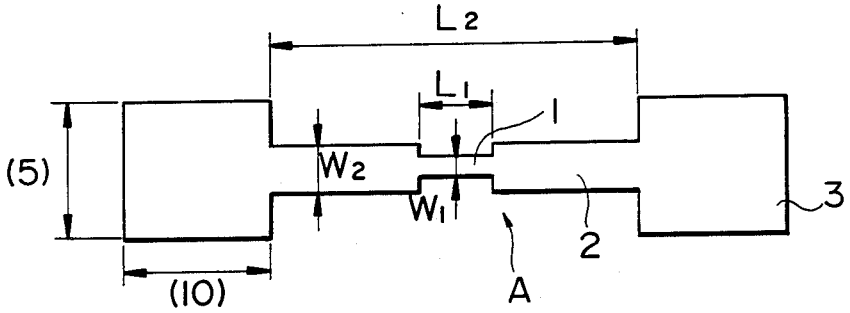
FIG. 1 is a plan view of a sample of a fuse made of a material embodying the present invention.

FIG. 1 is a plan view of a sample of a fuse A obtained by stamping. As shown in FIG. 1, the fuse sample A consists of an elongate body 2 having a length $L_2$ and a width $W_2$ and a pair of conductor connecting portions 3 extending in opposite directions from the body 2 and having a width larger than that of the body 2. The body 2 includes a central circuit-breaking melt-down portion 1 having a length $L_1$ smaller than $L_2$ and a width $W_1$ smaller than $W_2$. Various materials including that of the present invention as shown in Table 1 were used to form such fuse samples A having a thickness of 0.4 mm, and the dimensions of $L_1$, $W_1$, and $L_2$, $W_2$ were adjusted to meet a current rating of 45 amperes. The unit of dimensions in the parentheses shown in FIG. 1 is millimeter.

Figure 2:
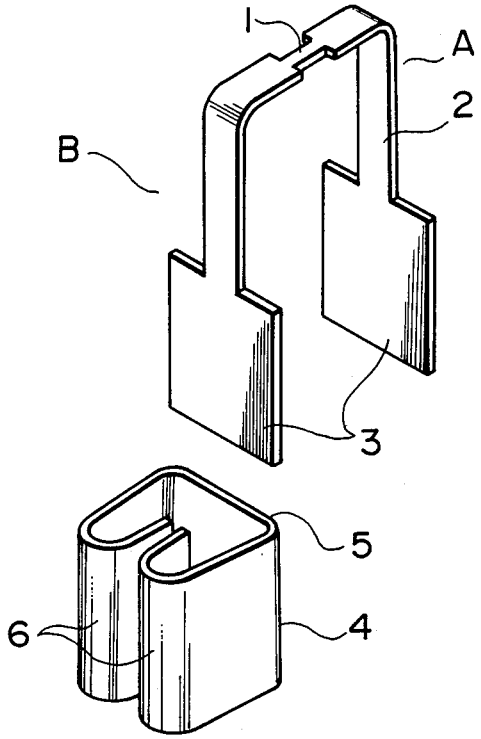
FIG. 2 is an exploded perspective view of an assembly consisting of the fuse sample shown in FIG. 1 and an associated terminal member.

Each of such fuse samples A was bent into a symmetrical U-shape as shown in FIG. 2 and was assembled with a terminal member 4 having a pair of elastic conductor-holding arms 6 extending from a base 5. The assembly B shown in FIG. 2 was fixed in a plastic casing 7 as shown in FIG. 3, and a pair of tab terminals 8 having conductors 9 crimped thereto were fitted into the plastic casing 7 to test the fuse sample A.

The fuse sample A was subjected to two kinds of tests, that is, a motor current cyclic test for determining the useful service life of the fuse sample and a temperature rise test for measuring the temperature rise due to heat generated from the fuse sample under a normal current-conducting condition.

Figure 4:
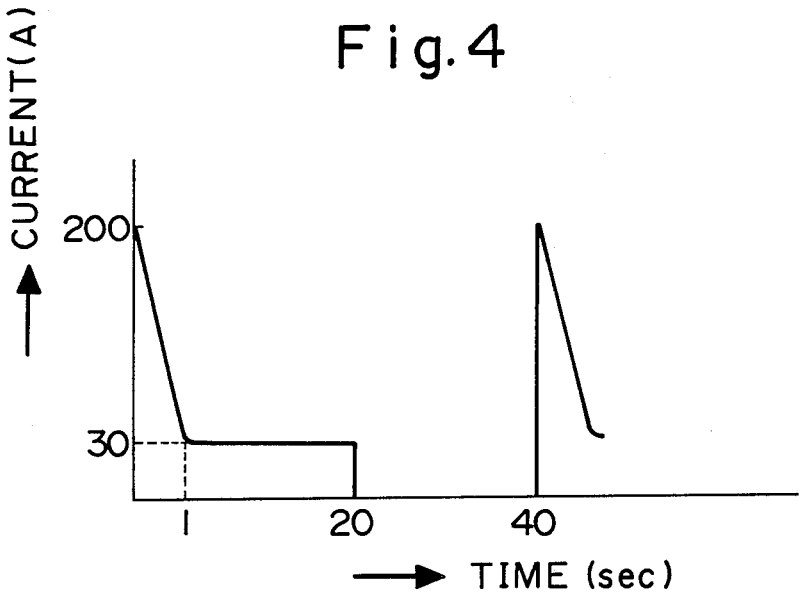
FIG. 4 is a graph showing a current waveform used in a motor current cyclic test on the assembly shown in FIG. 2.

In the motor current cyclic test, the sample was placed in an environment maintained at a temperature of 80° C., and a current waveform as shown in FIG. 4 was repeatedly supplied to the sample over 200,000 cycles to check whether or not the circuit-breaking melt-down occurred during this endurence test.

Figure 3:
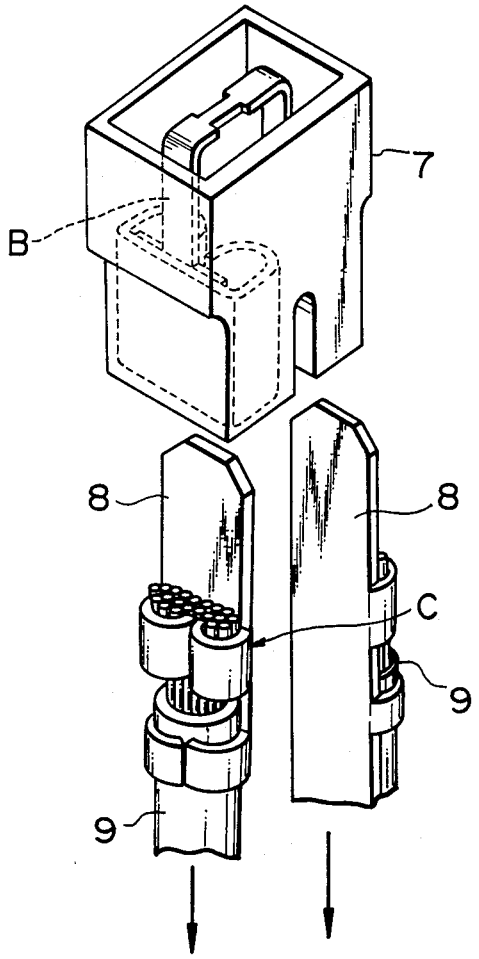
FIG. 3 shows the structure of a device used for testing the useful service life and temperature rise of the assembly shown in FIG. 2.

In the temperature rise test, a current of 30 amperes was continuously supplied to the sample kept at a temperature of 80° C., and a copper-constantan thermocouple (not shown) fixed to the rear surface of the conductor-crimped part C shown in FIG. 3 was used to measure the temperature rise of the sample.

The results of these tests are shown in Table 1. It will be seen in Table 1 that the fuse made of the material according to the present invention shows a temperature rise less than that of conventional fuses and has an excellent durability. Especially, the fuse having a tin plating in addition to the copper plating shows a further suppressed temperature rise.

The thickness of the copper plating and that of the material of the fuse samples of the present invention were changed, and similar tests were conducted on such fuse samples. The test results are shown in Table 2. It will be seen from Table 2 that a rollable aluminum alloy, when used in lieu of the aluminum, can also be preferably employed as the material of the fuse which generates a small quantity of heat, which has a long useful service life and which is suitable for use in a circuit where a relatively large current flows.

TABLE 1

| | Sample No. | Sample | Cyclic test | Temperature rise (°C.) |
|---|---|---|---|---|
| Prior art | 1 | Zn | Melt-down occurred after about 2,000 cycles | 28.5–32.3 |
| | 2 | Zn containing 2% of Cu (JP-A-53-138918) | Melt-down occurred after about 3,000 cycles | 30.7–33.5 |
| | 3 | CDA 19400 (JP-A-58-163127) | No melt-down occurred after 200,000 cycles | 42.7–49.1 |
| Present invention | 4 | Al with Cu plating (1 μm) | No melt-down occurred after 200,000 cycles | 32.2–34.7 |
| | 5 | Al with Cu plating (1 μm) + Sn plating (1 μm) | No melt-down occurred after 200,000 cycles | 30.5–32.5 |

Remarks: Al used as the material is JISH4000 A1080.

TABLE 2

| | Sample No. | Sample | Cyclic test | Temperature rise (°C.) |
|---|---|---|---|---|
| Present invention | 6 | Al with Cu plating (3 μm) (Al: A1080) | No melt-down occured after 200,000 cycles | 32.0–33.8 |
| | 7 | Al with Cu plating (1 μm) (Al:A1200) | No melt-down occured after 200,000 cycles | 32.8–33.5 |
| | 8 | Al with Cu plating (1 μm) (Al:A2218) | No melt-down occured after 200,000 cycles | 34.5–35.2 |

Remarks:
A1200 and A2218 are specified in JIS as materials suitable for forming plates, bars, sheets, strips, etc.

The fuse made of the material embodying the present invention shows a small temperature rise and has a high durability for the reasons which will be described below.

When the fuse is connected in a circuit where a relatively large current flows, local melting of the aluminum base starts first at about 660° C. due to heat generated as a result of conduction of the current. Although the current tends to flow more through the copper plating than the aluminum base of molten state, the melting point of copper is quickly reached because the thickness of the copper plating is 3 μm at the most. Since, at this time, the aluminum base is in its locally molten state already and is sharply severed at the molten area without the chance of forming its oxide film. Thus, although the fuse is locally heated up to a high temperature, the length of time elapsed until attainment of such a high temperature level is very short. Therefore, an adjacent part is not adversely affected by the heat generated from the fuse, and the safety of the adjacent part is ensured.

Also, the metal particles of the fuse of the present invention do not become excessively large unlike those of zinc, and the fuse has a long useful service life as will be apparent from Tables 1 and 2.

It will be understood from the foregoing description that a fuse made of the material according to the present invention generates a small quantity of heat and has a long useful service life when connected in a circuit where a relatively large current flows. Further, since the material costs of aluminum and copper, as well as that of tin, used for making the fuse are low, the fuse can be produced at a low cost.

What is claimed is:

1. A fuse comprising an elongate fuse body and a pair of conductor connecting portions extending from said fuse body and having a width greater than the width of the fuse body, wherein the fuse body comprises a circuit breaking member which melts and terminates a current flow through the fuse, said circuit breaking member being provided with a width less than the width of the fuse body an being formed from elemental aluminum, said circuit breaking member having a layer of copper deposited thereon.

2. A fuse according to claim 1, wherein a tin layer is further deposited on said copper plating.

3. A fuse according to claim 1, wherein the fuse body is interposed between the pair of conductor connector portions.

4. A fuse according to claim 3, wherein the conductor connector portions extend in generally opposite directions away from the fuse body.

5. A fuse according to claim 1, wherein the copper layer has a thickness of from about 1 $\mu$m to about 5 $\mu$m.

6. A fuse according to claim 1, wherein the fuse body is provided with a length $L_2$ and the circuit breaking member is provided with a length $L_1$, said fuse body length $L_2$ being greater than the length of $L_1$ of the circuit breaking member.

7. A fuse comprising an elongate fuse body and a pair of conductor connecting portions extending from said fuse body and having a width greater than the width of the fuse body, wherein the fuse body comprises a circuit breaking member which melts and terminates a current flow through the fuse, said circuit breaking member being provided with a width less than the width of the fuse body and being formed from a rollable aluminum alloy, said circuit breaking member having a layer of copper deposited thereon.

8. A fuse according to claim 7, wherein a tin layer is further deposited on said copper plating.

9. A fuse according to claim 3, wherein the fuse body is interposed between the pair of conductor connector portions.

10. A fuse according to claim 9, wherein the conductor connector portions extend in generally opposite directions away from the fuse body.

11. A fuse according to claim 3, wherein the copper layer has a thickness of from about 1 $\mu$m to about 5 $\mu$m.

12. A fuse according to claim 3, wherein the fuse body is provided with a length $L_2$ and the circuit breaking member is provided with a length $L_1$, said fuse body length $L_2$ being greater than the length $L_1$ of the circuit breaking member.

13. A fuse according to claim 3, wherein the aluminum alloy comprises Al:A1200.

14. A fuse according to claim 3, wherein the aluminum alloy comprises Al:A2218.

15. A fuse insertable into an electrical circuit, comprising a circuit-breaking member which melts and terminates a current flow in response to current flow through the fuse in excess of a predetermined value, said circuit-breaking member being formed from elemental aluminum and having a layer of copper deposited thereon and a layer of tin deposited over said layer of copper.

16. A fuse insertable into an electrical circuit, comprising a circuit-breaking member which melts and terminates a current flow in response to current flow through the fuse in excess of a predetermined value, said circuit-breaking member being formed from a rollable aluminum alloy and having a layer of copper deposited thereon and a layer of tin deposited over said layer of copper.

* * * * *